US005642819A

United States Patent [19]

Ronia

[11] Patent Number: 5,642,819

[45] Date of Patent: Jul. 1, 1997

[54] CHRISTMAS STOCKING HOLDER

[76] Inventor: Ernesto Ronia, 24828 19th Place S., Des Moines, Wash. 98198

[21] Appl. No.: 614,674

[22] Filed: Mar. 13, 1996

[51] Int. Cl.[6] ..... A47F 5/00

[52] U.S. Cl. ..... 211/86.01; 248/231.71; D11/117; D11/126

[58] Field of Search ..... 211/86, 105.1, 211/162; 248/231.71, 228.6, 229.15, 229.25; D11/117, 126, 130; D26/9

[56] References Cited

U.S. PATENT DOCUMENTS

| | | | |
|---|---|---|---|
| D. 194,002 | 11/1962 | Pincus | D11/126 |
| D. 218,615 | 9/1970 | Adler | D11/117 X |
| D. 289,585 | 5/1987 | Lord | D6/414 |
| D. 364,523 | 11/1995 | Carter | D11/126 X |
| 2,385,296 | 9/1945 | Moore | 211/86 X |
| 2,504,821 | 4/1950 | Fowler | 211/86 X |
| 2,621,503 | 12/1952 | Schaefer | D26/9 X |
| 2,631,807 | 3/1953 | Witt | 248/229.15 |
| 2,638,301 | 5/1953 | Smith | 248/229.15 |
| 2,659,561 | 11/1953 | Kindorf | 248/228.6 |
| 2,896,896 | 7/1959 | Revzin | 248/229.15 |
| 3,178,144 | 4/1965 | Kimoto | 211/105.1 X |
| 3,535,508 | 10/1970 | Warshauser | 248/231.71 X |
| 3,591,118 | 7/1971 | Gentile | 248/231.71 |
| 3,647,078 | 3/1972 | Fortunato | 248/231.71 X |
| 3,902,931 | 9/1975 | Danciger et al. | 248/231.71 X |
| 3,990,582 | 11/1976 | Schindel | 211/105.1 |
| 4,685,644 | 8/1987 | Yates | 248/231.71 X |
| 4,702,448 | 10/1987 | LoJacono et al. | 248/231.71 X |
| 4,709,891 | 12/1987 | Barnett | 248/231.71 X |
| 4,762,238 | 8/1988 | Blanchard | 211/123 |
| 4,903,929 | 2/1990 | Hoffman | 248/229.15 |
| 5,370,570 | 12/1994 | Harris | 248/231.71 X |
| 5,582,379 | 12/1996 | Keselman et al. | 248/229.25 X |

*Primary Examiner*—Leslie A. Braun
*Assistant Examiner*—Sandra Snapp

[57] ABSTRACT

A Christmas stocking and candle holder, comprising, a plurality of C-shaped brackets. Each bracket has an upper linear segment with an interior end and an exterior free end. A lower linear segment is parallel with the upper linear segment. The lower segment has an interior end and an exterior free end. A vertical segment couples the upper and lower segments adjacent to the interior ends thereof. Each of the C-shaped brackets has a T-shaped channel in the lower segment extending from the free end thereof with an elongated slot extending downwardly from the upper surface of the upper segment and overlying the recess. A plurality of nuts are provided. Each nut has female threads formed therein positioned in and supported by the channel of the lower segment. A plurality of bolts is also provided. Each bolt has a threaded exterior surface extending upwardly from beneath the lower surface of the lower segment into the channel and is threadedly coupled within the nut. The bolt has an essentially circular eye extending downwardly from the channel. The circular segment of each bolt has a common axis in alignment with the axes of the other bolts.

6 Claims, 3 Drawing Sheets

CHRISTMAS STOCKING HOLDER

BACKGROUND OF THE INVENTION

1. Field of the Invention

The present invention relates to a Christmas stocking holder and, more particularly, pertains to attaching Christmas stockings and candles to a mantle or window sill through cooperative brackets and a dowel.

2. Description of the Prior Art

The use of devices for holding Christmas stockings, candles and other objects with respect to a fireplace mantle or other appropriate region of various designs and configurations are known in the prior art. More specifically, devices for holding Christmas stockings, candles and other objects with respect to a fireplace mantle or other appropriate region of various designs and configurations heretofore devised and utilized for the purpose of supporting Christmas stockings, candles and other objects in an intended locations through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. Des. 289,585 to Lord discloses a support stand for Christmas stockings.

U.S. Pat. No. 3,760,995 to Wheeler discloses a hanger attachment rod.

U.S. Pat. No. Des. 349,000 to Rogers et al discloses a combined shelf and hanger rod.

U.S. Pat. No. 3,990,582 to Schindel discloses a hanger rod assembly.

Lastly, U.S. Pat. No. 4,762,238 to Blanchard discloses an auxiliary hanger rod support.

In this respect, the Christmas stocking holder according to the present invention substantially departs from the conventional concepts and designs of the prior art, and in so doing provides an apparatus primarily developed for the purpose of attaching Christmas stockings and candles to a mantle or window sill through cooperative brackets and a dowel.

Therefore, it can be appreciated that there exists a continuing need for new and improved Christmas stocking holder which can be used for attaching Christmas stockings and candles to a mantle or window sill through cooperative brackets and a dowel. In this regard, the present invention substantially fulfills this need.

SUMMARY OF THE INVENTION

In view of the foregoing disadvantages inherent in the known types of devices for holding Christmas stockings, candles and other objects with respect to a fireplace mantle or other appropriate region of various designs and configurations now present in the prior art, the present invention provides an improved Christmas stocking holder. As such, the general purpose of the present invention, which will be described subsequently in greater detail, is to provide a new and improved Christmas stocking holder apparatus and method which has all the advantages of the prior art and none of the disadvantages.

To attain this, the present invention essentially comprises a new and improved Christmas stocking and candle holder. Such Christmas stocking and candle holder comprises a plurality of C-shaped brackets. Each bracket has an upper linear segment with an interior end and an exterior free end. A lower linear segment is parallel with the upper linear segment. The lower segment has an interior end and an exterior free end. A vertical segment couples the upper and lower segments adjacent to the interior ends thereof. Each of the C-shaped brackets has a T-shaped channel in the lower segment extending from the free end thereof with an elongated slot extending downwardly from the upper surface of the upper segment and overlying the recess. A plurality of nuts are provided. Each nut has female threads formed therein positioned in and supported by the channel of the lower segment. A plurality of bolts is also provided. Each bolt has a threaded exterior surface extending upwardly from beneath the lower surface of the lower segment into the channel and is threadedly coupled within the nut. The bolt has an essentially circular eye extending downwardly from the channel. The circular segment of each bolt has a common axis in alignment with the axes of the other bolts. An elongated dowel with a circular cross section is positioned through the eyes of the dowels to provide a region for supporting Christmas stocking between the dowels when the dowels are positioned on a planar surface such as a fireplace mantel, window sill or the like. A plurality of bowls are provided. Each bowl has a lower planar surface coupled to the upper surface of an associated upper segment. Each bowl also has a cylindrical recess extending downwardly from the upper surface of an associated bowl. A candle of a cylindrical configuration is provided and has an upper end with a wick and a lower end positioned within each recess. A Christmas stocking with a loop at the upper end is positioned on the dowel for being supported thereby.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Christmas stocking holder which has all the advantages of the prior art devices for holding Christmas stockings, candles and other objects with respect to a fireplace mantle or other appropriate region of various designs and configurations and none of the disadvantages.

It is another object of the present invention to provide a new and improved Christmas stocking holder which may be easily and efficiently manufactured and marketed.

It is a further object of the present invention to provide a new and improved Christmas stocking holder which is of a durable and reliable construction.

An even further object of the present invention is to provide a new and improved Christmas stocking holder which is susceptible of a low cost of manufacture with regard to both materials and labor, and which accordingly is then susceptible of low prices of sale to the consuming public, thereby making such devices for holding Christmas stockings, candles and other objects with respect to a fireplace mantle or other appropriate region of various designs and configurations economically available to the buying public.

Still yet another object of the present invention is to provide a new and improved Christmas stocking holder which provides in the apparatuses and methods of the prior art some of the advantages thereof, while simultaneously overcoming some of the disadvantages normally associated therewith.

Still another object of the present invention is to attaching Christmas stockings and candles to a mantle or window sill through cooperative brackets and a dowel.

Lastly, it is an object of the present invention to provide a new and improved Christmas stocking holder, comprising, a plurality of C-shaped brackets. Each bracket has an upper linear segment with an interior end and an exterior free end. A lower linear segment is parallel with the upper linear segment. The lower segment has an interior end and an exterior free end. A vertical segment couples the upper and lower segments adjacent to the interior ends thereof. Each of the C-shaped brackets has a T-shaped channel in the lower segment extending from the free end thereof with an elongated slot extending downwardly from the upper surface of the upper segment and overlying the recess. A plurality of nuts are provided. Each nut has female threads formed therein positioned in and supported by the channel of the lower segment. A plurality of bolts is also provided. Each bolt has a threaded exterior surface extending upwardly from beneath the lower surface of the lower segment into the channel and is threadedly coupled within the nut. The bolt has an essentially circular eye extending downwardly from the channel. The circular segment of each bolt has a common axis in alignment with the axes of the other bolts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
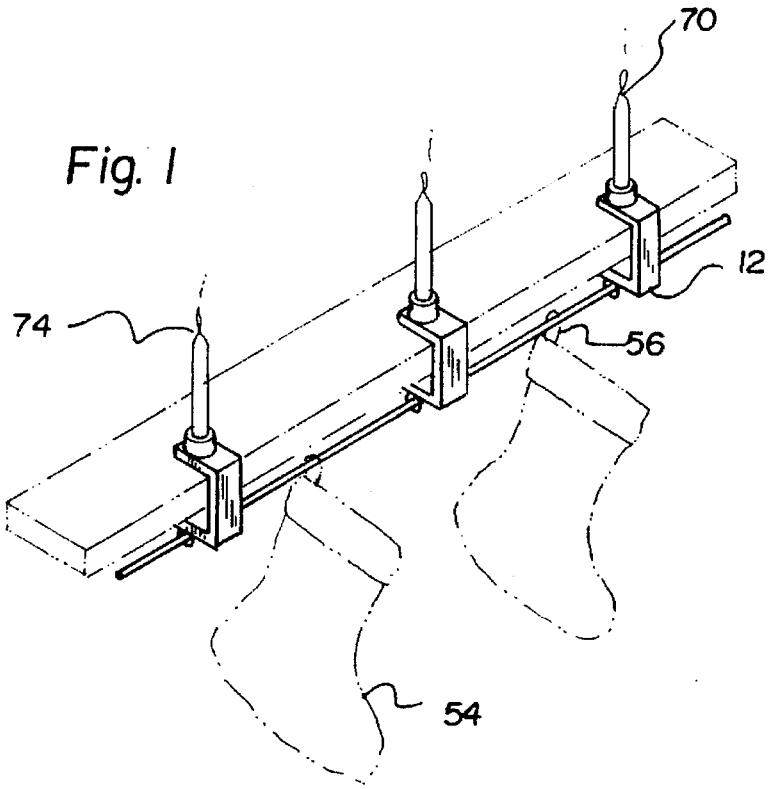
FIG. 1 is a perspective illustration of the preferred embodiment of the Christmas stocking holder constructed in accordance with the principles of the present invention.
Figure 2:
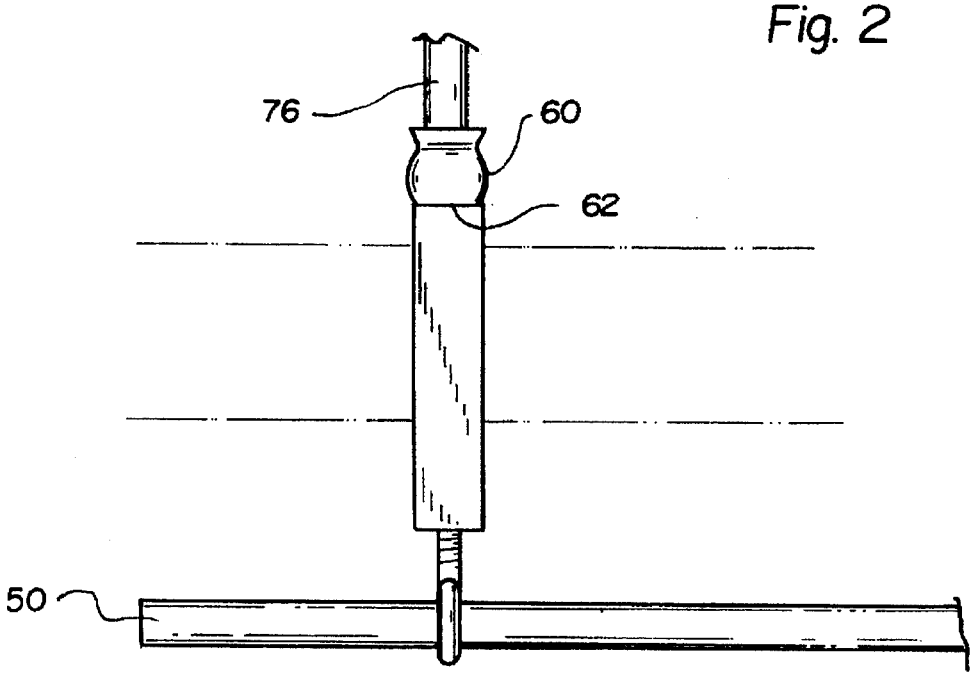
FIG. 2 is a front elevational view of the apparatus shown in FIG. 1.
Figure 3:
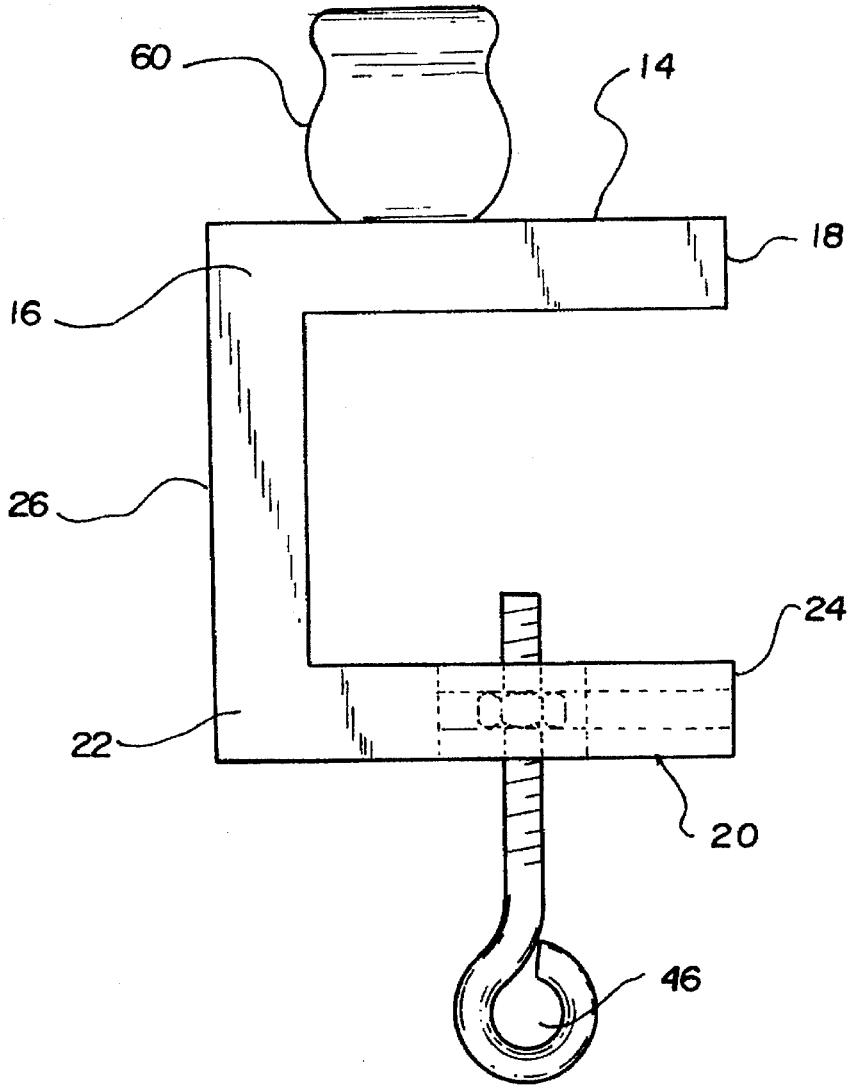
FIG. 3 is a side elevational view of one of the brackets shown in FIGS. 1 and 2.
Figure 4:
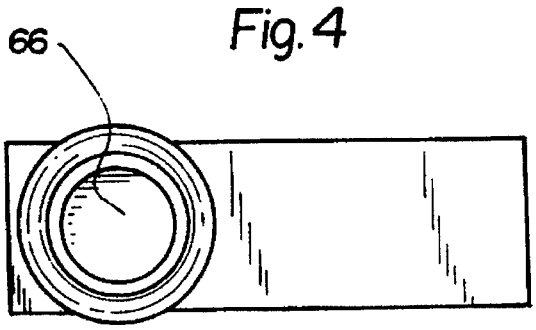
FIG. 4 is top view of the bracket shown in FIG. 3.
Figure 5:
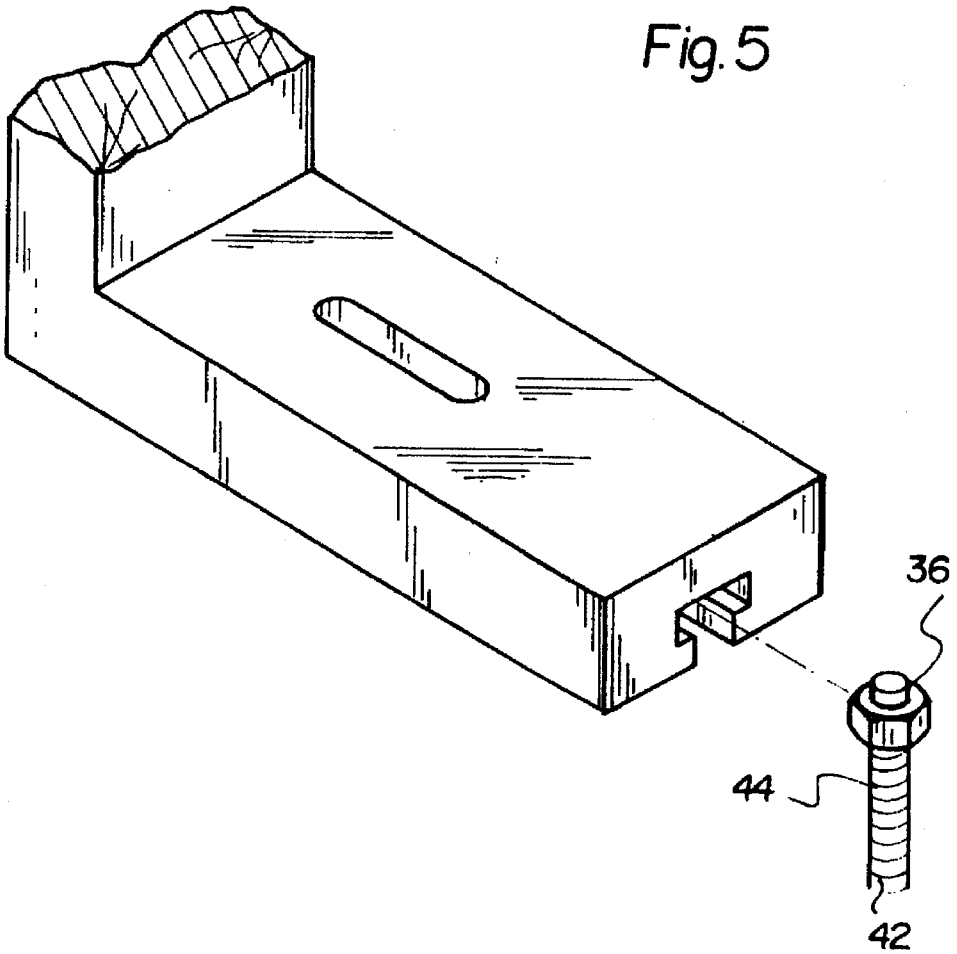
FIG. 5 is a cross sectional view of a lower linear segment of the present invention
Figure 6:
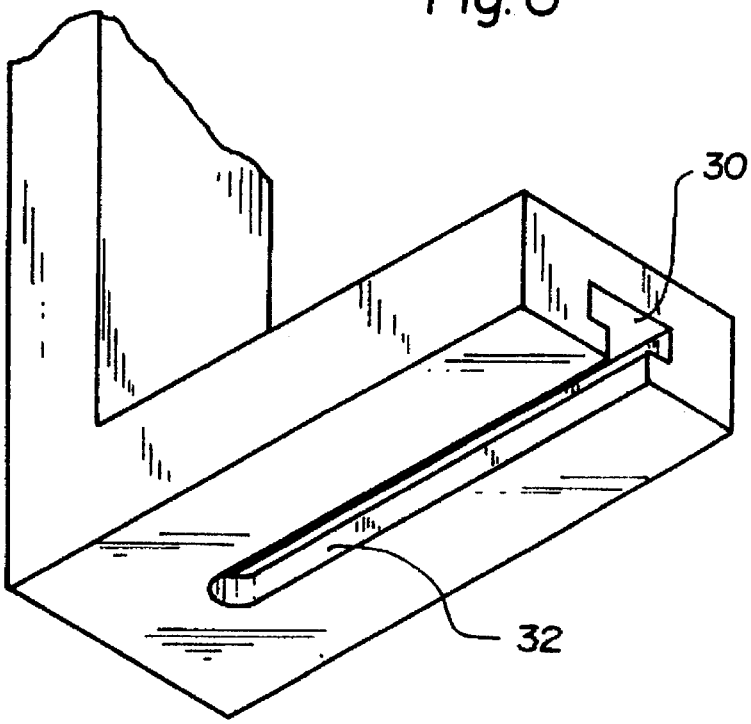
FIG. 6 is an exploded cross sectional view of a portion of the mantle and sleeve shown in the prior Figures.

With reference now to the drawings, and in particular to FIG. 1 thereof, a new and improved Christmas stocking holder embodying the principles and concepts of the present invention and generally designated by the reference numeral 10 will be described.

The present invention, the new and improved Christmas stocking holder, is comprised of a plurality of components. Such components in their broadest context include a plurality of brackets, nuts, bolts and a dowel. Such components are individually configured and correlated with respect to each other so as to attain the desired objective.

More specifically, the present invention may be construed as a system 10. The central component of such system is a plurality of C-shaped brackets 12. Each bracket has an upper linear segment 14 with an interior end 16 and an exterior free end 18. Each bracket also has lower linear segment 20. Such lower linear segment is parallel with the upper linear segment. The lower segment has an interior end 22 and an exterior free end 24. A vertical segment 26 couples the upper and lower segments adjacent to the interior ends thereof.

Each of the C-shaped brackets has a T-shaped channel 30 in the lower segment. Such channel extends from the free end thereof. The channel has an elongated slot 32 which extends downwardly from the upper surface of the upper segment and overlies the recess.

Next provided is a plurality of nuts 36. Each nut has female threads 38 formed therein. Such female threads are positioned in and supported by the channel of the lower segment.

Next provided in the system 10 of the present invention are a plurality of bolts 42. Each bolt has a threaded exterior surface 44. Such surface extends upwardly from beneath the lower surface of the lower segment into the channel. Such surface is threadedly coupled within the nut. Each bolt has an essentially circular eye 46 and extends downwardly from the channel. The circular segment of each bolt has a common axis in alignment with the axes of the other bolts.

Coupling between the brackets and bolts is effected through an elongated dowel 50. The dowel has a circular cross section and is positioned through the eyes of the dowels to provide a region for supporting a Christmas stocking 54 between the dowels. This allows for positioning the dowels on a planar surface such as a fireplace mantel, window sill or the like. The Christmas stocking has a loop 56 at the upper end and is positioned on the dowel for being supported thereby. There is preferably a Christmas stocking positionable between each adjacent C-shaped bracket. Note FIG. 1.

Next provided are a plurality of bowls 60. Each bowl has a lower planar surface 62. Such lower surface is coupled to the upper surface of an associated upper segment. Each bowl also has a cylindrical recess 66 and extends downwardly from the upper surface of an associated bowl.

Further provided in the system 10 of the present invention is a candle 70. Such candle is of a cylindrical configuration. The candle has an upper end with a wick 74. The candle further has a lower end 76 positioned within each recess. A candle is provided for each C-shaped bracket.

The present invention is a device for holding Christmas stockings that is attached to a fireplace mantle or window sill. It is made of molded plastic or die cast metal and consists of a ⅜ inch diameter rod, two to three clamps, and two to three eye screws, depending on the number of stockings to be hung. The rod's length and the size of the clamps depends on the size of the fireplace mantle or window sill on which the device is used. The ends of the rod are rounded for attractiveness and to prevent injury to the users. Each of the C-shaped brackets has a T-shaped channel in the lower segment extending from the free end thereof with an elongated slot extending downwardly from the upper surface of the upper segment and overlying the recess. An attractive Christmas decoration, for example, Santa Claus or a candle, can be carved or embossed on the clamp's outside face. The diameter of each eye screw is slightly larger than the rod's diameter.

The eye screws are fastened to the clamps, which are mounted onto the mantle, and the screws are tightened to hold the clamps securely in place. The rod is inserted through the eye and Christmas stockings are hung from the rod. Candles are inserted into the holes on the clamp's tops if desired.

This holder provides an easy method for hanging Christmas stockings without marring the mounting surface in the process.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved Christmas stocking and candle holder, comprising, in combination:

a plurality of C-shaped brackets, each bracket having an upper linear segment with an interior end and an exterior free end, a lower linear segment parallel with the upper linear segment, the lower segment having an interior end and an exterior free end, and a vertical segment coupling the upper and lower segments adjacent to the interior ends thereof, each of the C-shaped brackets having a T-shaped channel in the lower segment extending from the exterior free end thereof with an elongated slot extending downwardly from the upper surface of the lower segment and overlying the channel;

a plurality of nuts, each nut having female threads formed therein positioned in and supported by the channel of the lower segment;

a plurality of bolts, each bolt having a threaded exterior surface extending upwardly from beneath the lower surface of the lower segment into the channel and threadedly coupled within the nut, the bolt having an essentially circular eye extending downwardly from the channel, the circular eye of each bolt having a common axis in alignment with the axes of the other bolts;

an elongated dowel with a circular cross section positioned through the eyes of the dowels to provide a region for supporting a Christmas stocking between the dowels when the dowels are positioned on a planar surface;

a plurality of bowls, each bowl having a lower planar surface coupled to the upper surface of an associated upper segment, each bowl also having a cylindrical recess extending downwardly from the upper surface of an associated bowl;

a candle of a cylindrical configuration having an upper end with a wick and a lower end positioned within each recess; and a Christmas stocking with a loop at the upper end positioned on the dowel for being supported thereby.

2. A Christmas stocking and candle holder, comprising:

a plurality of C-shaped brackets, each bracket having an upper linear segment with an interior end and an exterior free end, a lower linear segment parallel with the upper linear segment, the lower segment having an interior end and an exterior free end, and a vertical segment coupling the upper and lower segments adjacent to the interior ends thereof, each of the C-shaped brackets having a T-shaped channel in the lower segment extending from the exterior free end thereof with an elongated slot extending downwardly from the upper surface of the lower segment and overlying the channel;

a plurality of nuts, each nut having female threads formed therein positioned in and supported by the channel of the lower segment; and a plurality of bolts, each bolt having a threaded exterior surface extending upwardly from beneath the lower surface of the lower segment into the channel and threadedly coupled within the nut, the bolt having an essentially circular eye extending downwardly from the channel, the circular eye of each bolt having a common axis in alignment with the axes of the other bolts.

3. The device as set forth in claim 2 and further including an elongated dowel with a circular cross section positioned through the eyes of the dowels to provide a region for supporting a Christmas stocking between the dowels when the dowels are positioned on a planar surface.

4. The device as set forth in claim 2 and further including a Christmas stocking with a loop at the upper end positioned on the dowel for being supported thereby.

5. The device as set forth in claim 2 and further including a plurality of bowls, each bowl having a lower planar surface coupled to the upper surface of an associated upper segment, each bowl also having a cylindrical recess extending downwardly from the upper surface of an associated bowl.

6. The device as set forth in claim 2 and further including a candle of a cylindrical configuration having an upper end with a wick and a lower end positioned within each recess.

* * * * *